US008951140B1

(12) United States Patent
Kim

(10) Patent No.: US 8,951,140 B1
(45) Date of Patent: Feb. 10, 2015

(54) GOLF STANCE TRAINER

(71) Applicant: Richard Kim, Lincoln, NE (US)

(72) Inventor: Richard Kim, Lincoln, NE (US)

( * ) Notice: Subject to any disclaimer, the term of this patent is extended or adjusted under 35 U.S.C. 154(b) by 0 days.

(21) Appl. No.: 13/760,762

(22) Filed: Feb. 6, 2013

(51) Int. Cl.
*A63B 69/36* (2006.01)

(52) U.S. Cl.
CPC ..... *A63B 69/3667* (2013.01)
USPC ..... 473/272; 473/218; 473/273; 473/409

(58) Field of Classification Search
USPC ..... 473/218, 219, 257, 266, 270, 272, 273, 473/409
See application file for complete search history.

(56) References Cited

U.S. PATENT DOCUMENTS 2,180,170 A * 11/1939 Richards ..... 473/272
3,920,248 A * 11/1975 Medders ..... 473/218
4,647,048 A * 3/1987 Welch ..... 473/272
5,482,284 A * 1/1996 Vandever ..... 473/218
7,575,522 B1 * 8/2009 Affrunti ..... 473/273
8,246,482 B1 * 8/2012 Kim ..... 473/272

* cited by examiner

*Primary Examiner* — Nini Legesse
(74) *Attorney, Agent, or Firm* — James Creighton Wray

(57) ABSTRACT

A golf swing stance trainer has a hub and a central telescoping arm connected to the hub. Side telescoping arms are connected to the hub for swinging outward to positions perpendicular to the central arm. The hub has ground-engaging cleats on a lower surface. The central arm is selectively extended outward for position with respect to a ball position. The side arms are selectively extended outward to indicate desired foot positions. The central arm has an extension with a pivot for sliding outward from the central arm for training position and direction of a golf ball and direction and extent of a swing. Arm extensions are related to an individual user and club selection. The arms are telescoped inward and the side arms are swung inward for carrying. The hub includes a hinge rod with a central receive through which a connected on the central arm slides.

19 Claims, 11 Drawing Sheets

OPEN

CLOSE

GOLF STANCE TRAINER

BACKGROUND OF THE INVENTION

A golf stance trainer is described in U.S. Pat. No. 8,246,482 granted to Richard Kim on Aug. 21, 2012. The disclosure of that invention is incorporated herein as if fully set forth herein.

SUMMARY OF THE INVENTION

Briefly, the invention is a portable, retractable device that a golfer may use to insure that his stance and angles are correct when addressing a golf ball before striking the golf ball for a particular line of travel. The training device consists of three telescoping arms extending from a central pivot. When unfolded and fully extended, two of the arms extend one hundred and eighty degrees apart from the central pivot and form a straight base line approximately thirty-six inches in length.

A central arm extends from the central pivot point perpendicular to the base line. A first extending tube has a first pivot at an outer end. A second extending tube has a second pivot at an inner end. The second pivot engages the first pivot. The second extending tube and subsequent inner extension tubes may be extended in any direction from the outer end of the first extending tube.

The training device is used when aligning puts on a sloped green, for example. The base line arms are aligned with the hole, and the angular extension is aligned in a direction in which the ball must travel initially when struck by a putter. While holding the angular extension in the desired direction, the fixed central arm and the base line arms may be turned around the pivots to correctly align the golfer's feet. The central arm extension may be extended or shortened to indicate the length of putter follow through which is expected to travel after striking the ball. In practice, both the angle and the length of the central arm extension may be changed to direct the angle and the speed or length in which the putter must travel to produce the proper trajectory of the ball on its way to a cup or target.

The angle of the central arm extension may be reversed to guide the length and direction of a backswing estimated to be necessary for striking a ball in a correct direction with a correct speed to reach the cup or target. The central arm extension may be used when practicing swings of golf clubs in directions parallel to the extended central arm. The adjustable angular relation of the central arm extension may be used to teach and practice open and closed stances when swinging golf clubs.

When fully extended, the central arm is thirty-six inches in length. When extended in this manner, the Swing Master forms a "T" with a six inch middle perpendicular arm and a thirty inch angular extension and two eighteen inch base line arms. When fully telescoped and folded, the device measures approximately 7"×2"×1".

The new extensible compact golf stance trainer shown in the drawings has a central locator cover connected to a threaded end of an extension of a central telescoping ball distance locator arm. A hinge rod has a central opening through which the central arm extension passes before the threaded end of the extension is connected to a threaded receiver in the cover. The hinge rod has opposite slotted ends and bases. Hinge pins extend through openings in opposite sides of end portions of the hinge rod. The hinge rod may be made cylindrical or square with parallel wall portions having opposite hinge pin receiving holes perpendicular to and spaced from the central opening through which the extension slides.

These and further and other objects and features of the invention are apparent in the disclosure, which includes the above and ongoing written specification, with the claims and the drawings.

DETAILED DESCRIPTION OF THE DRAWINGS

Figure 1:
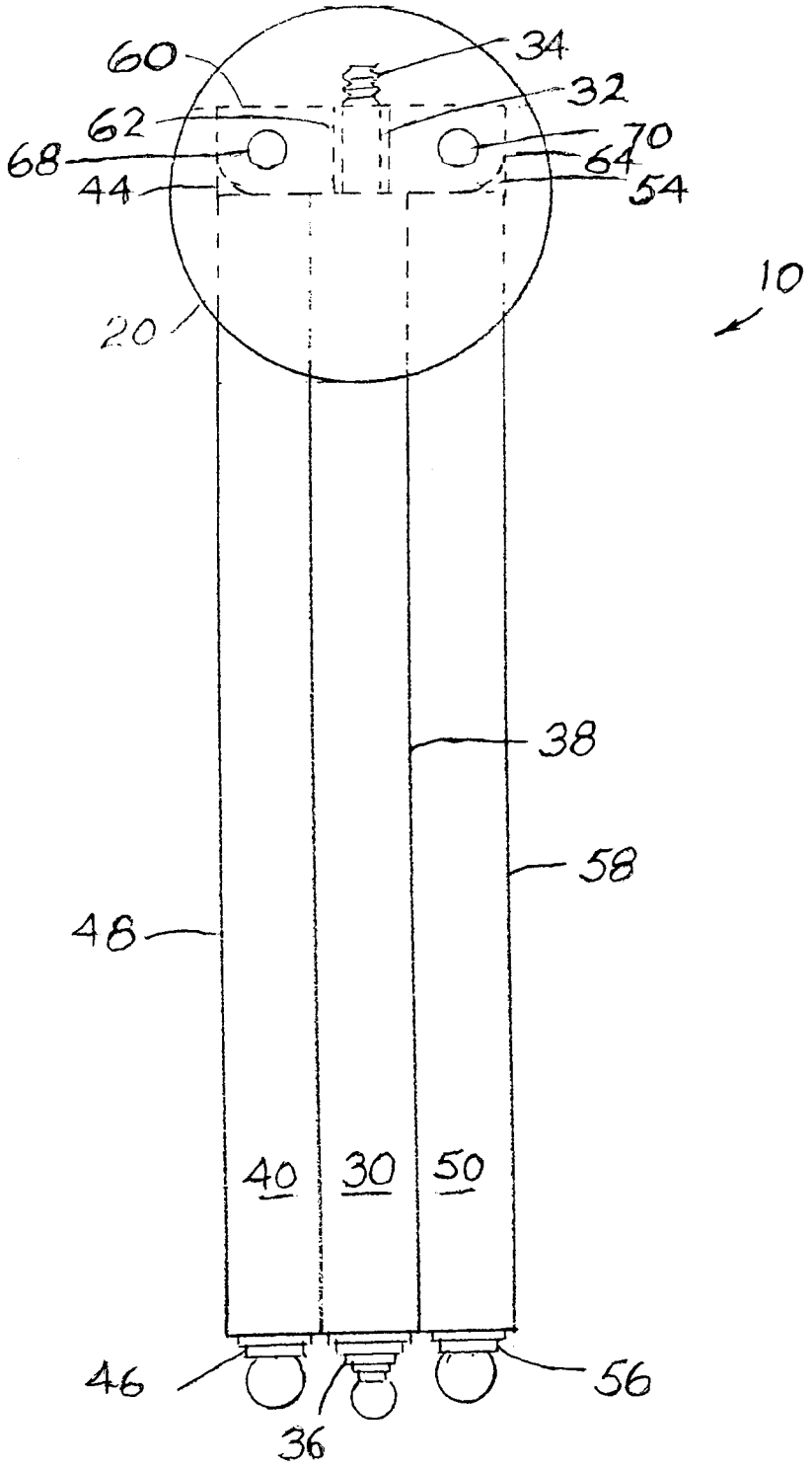
FIG. 1 is a top plan view of the golf stance trainer with arms telescoped and a hinge cover. The arms are folded for storing and carrying.
Figure 2:
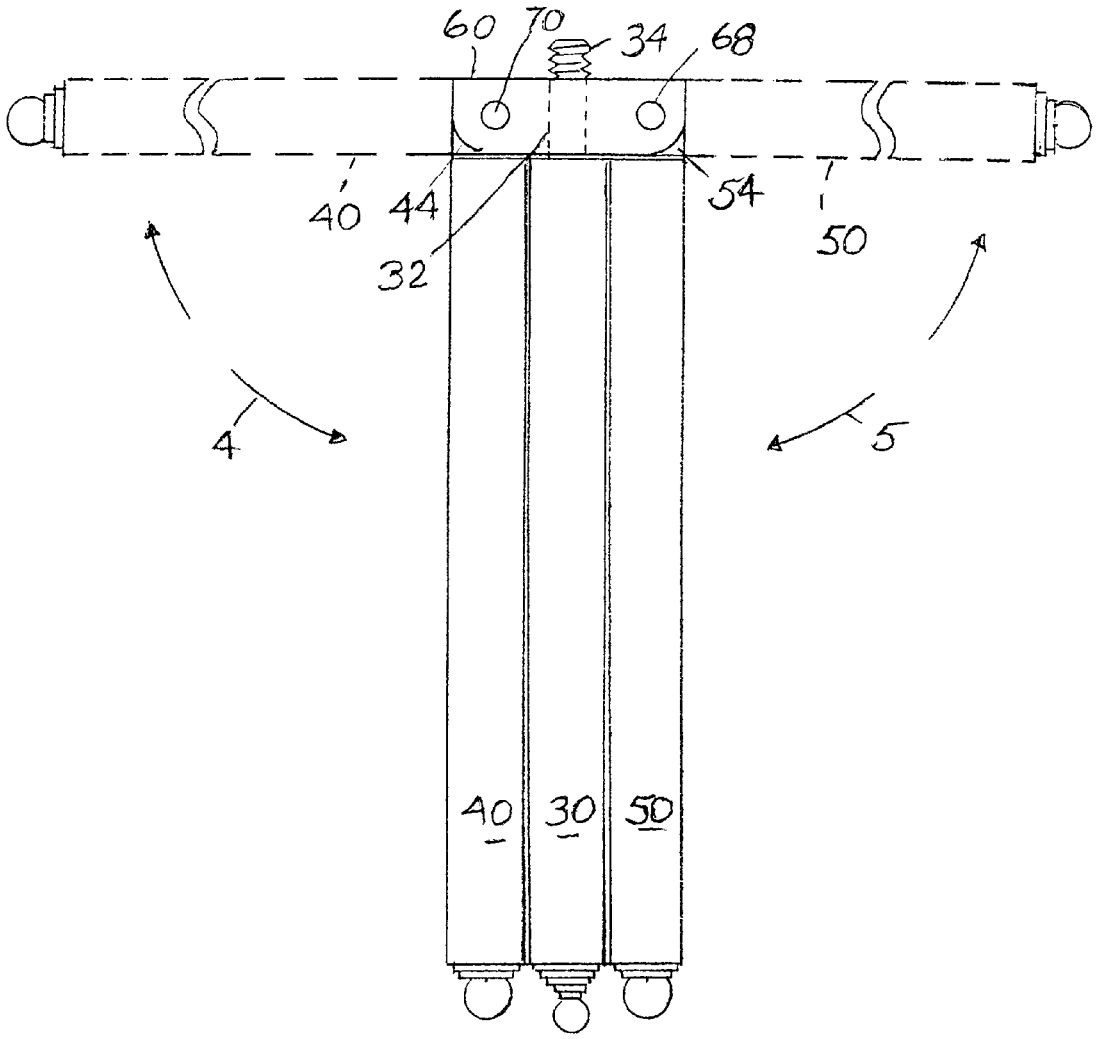
FIG. 2 is a top view of the trainer with the cover removed and with the hinged arms telescoped inward and folded for compact storing and carrying, showing how the side arms swing outward.

FIG. 1 is a top view of the golf stance 10 in storing and carrying condition with a cover 20 and telescoped arms 30, 40, 50. FIG. 2 is a top view of the trainer 10 with the cover 20 removed and with the hinged arms 40, 50 telescoped inward and folded for compact storing and carrying, showing by curved lines 4, 5 and dashed lines how the side arms 40, 50 swing out and in.

The new extensible compact golf stance trainer 10 shown in the drawings has a central locator cover 20 connected to a threaded end 34 of an extension 32 of a central telescoping ball distance locator arm 30. Foot position locator arms 40 and 50 have flattened inner ends 44, 54 which receive hinge pins 70 connected to hinge rod 60. A hinge rod 60 has a central opening 62 through which the extension 32 of arm 30 passes before the threaded end 34 is connected to a threaded receiver 24 in the cover 20. The hinge rod 60 has opposite ends 64 and bases 66 with recessed slots. Hinge pins 70 extend through openings 68 in opposite sides of end portions 64 of the hinge rod 60. The hinge rod may be made of a cylindrical or square rod with openings 68 in wall portions spaced from and perpendicular to the central openings 62 through which the central arm extension 32 slides.

As shown in FIG. 1, the trainer 10 is folded. The cover 20 is connected to the threads 34 on extension 32 of central ball locating arm 30. Arms 40 and 50 are folded about pins 70 in hinge rod 60 and stored parallel with arm 30. The telescoping arm extensions 36, 46, 56 have been slid inward in the outer tubes 38, 48, 58.

The outer tubes 48 and 58 have pin-receiving holes in flattened inner ends 44, 54. Ends 64 and bases 66 of hinge rod 60 are slotted 67 to receive the flattened ends in folded and extended positions of the arms. Holes in the flattened ends 44, 54 are aligned with paired holes 68 in hinge rod 60. Hinge pins 70 are inserted in the aligned holes. The hinge pins are set screws 70 with smooth shafts and threaded ends. Holes 68 in one side of the hinge rod are countersunk to receive the heads of set screws. Opposite holes in the hinge rod are tapped to receive threads of the set screws 70. When cover 20 is attached to threads 34 on the extension 32 of the fixed middle arm 30, the cover prevents unintentional backing out of the set screws 70.

In one embodiment, the flattened ends 44, 54 are provided on solid inserts which are crimped or welded in hinged inner ends of the arms 40 and 50. The ends of the tubes may have slots aligned with slots in the solid inserts and washer clips inserted in the aligned slots to hold inserts in the tube ends. Alternatively, the flattened ends 44, 54 may be flattened from the tubes 40, 50, and then drilled.

Figure 3:
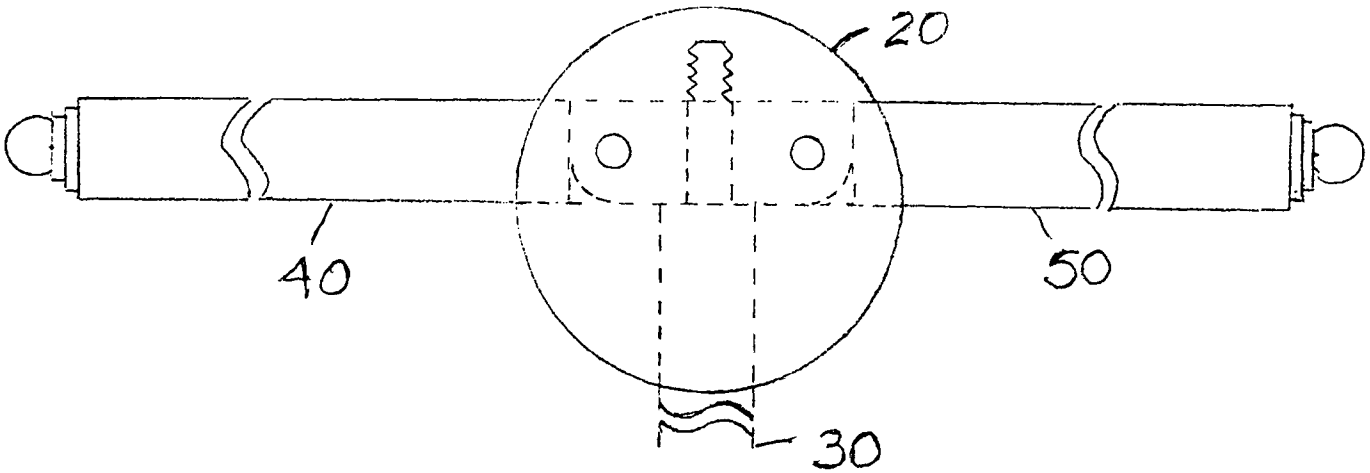
FIG. 3 is a top view detail showing the central locator cover connected to a threaded extension on the central ball distance locator arm and the side foot spacing arms rotated to their position of use before extending the foot spacing side arms.

FIG. 3 is a top view detail showing the central trainer locator cover 20 connected to the threaded end 34 extension 32 on the central ball distance locator arm 30. The side foot spacing arms 40, 50 have been rotated around pins 70 to their operational position of use before extending the foot spacing extension 46, 56 inside arms 40, 50.

Figures 4, 5:
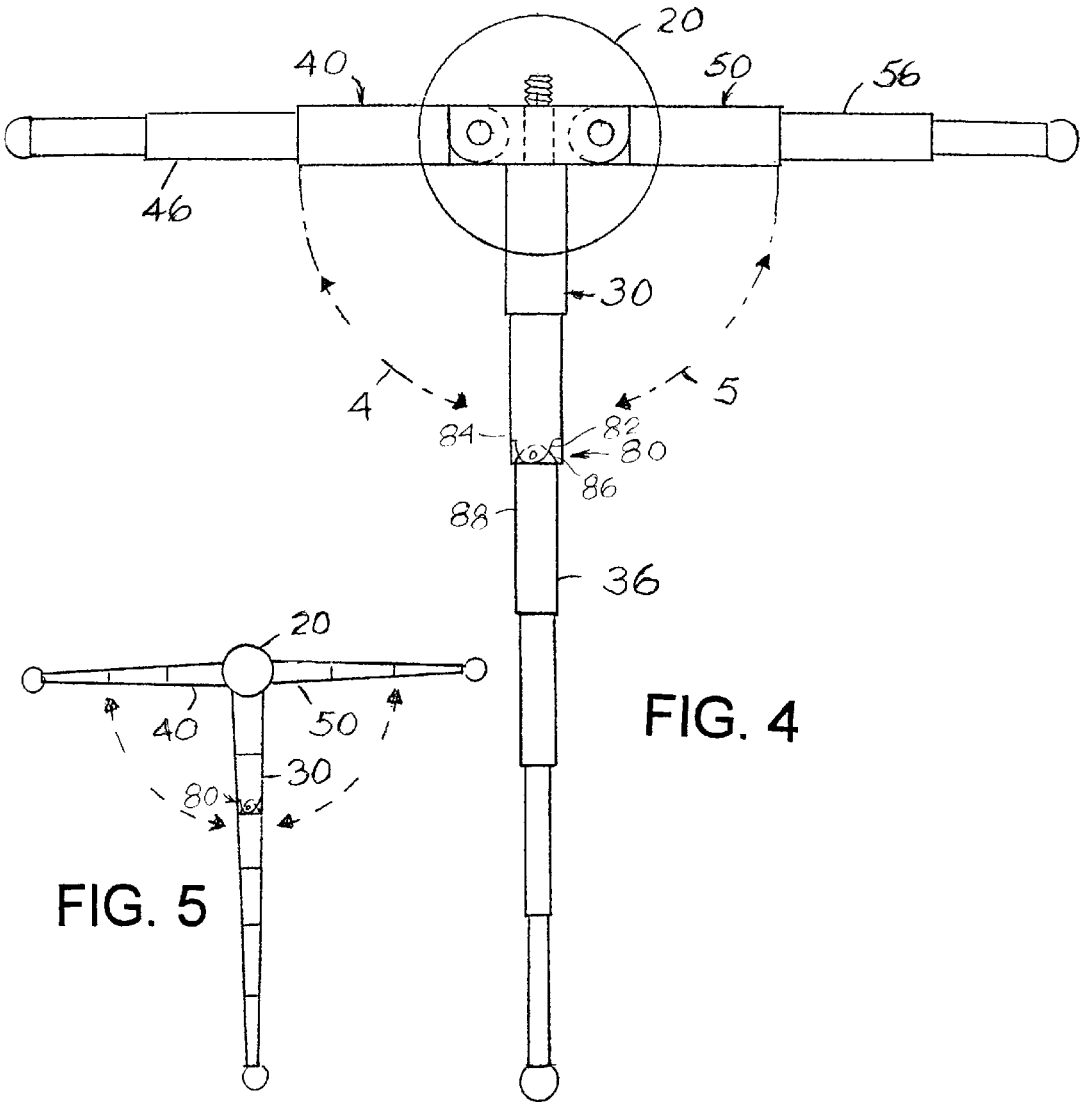
FIG. 4 is top view of the golf stance trainer with the arms extended and the cover in partially cut away view to show the relation and interconnection of the elements.
FIG. 5 is top schematic view of the golf stance trainer with the arms extended.

FIG. 4 is top view of the golf stance trainer 10 with the arms 40 and 50 rotated outward and telescoping tubes 36, 46, 56 extended. The cover 20 is partially cut away to show the relation and interconnection of the elements. The curved lines 4, 5 show rotations of the arms 40, 50 between the operational position as shown and the storage position. The hinges 80 include a clevis 82 on an outer end of the first central arm extension tube 84 and a projection 86 on an inner end of the second extension tube 88.

FIG. 5 is top schematic view of the golf stance trainer 10 with the arms 30, 40, 50 extended.

Figure 6:
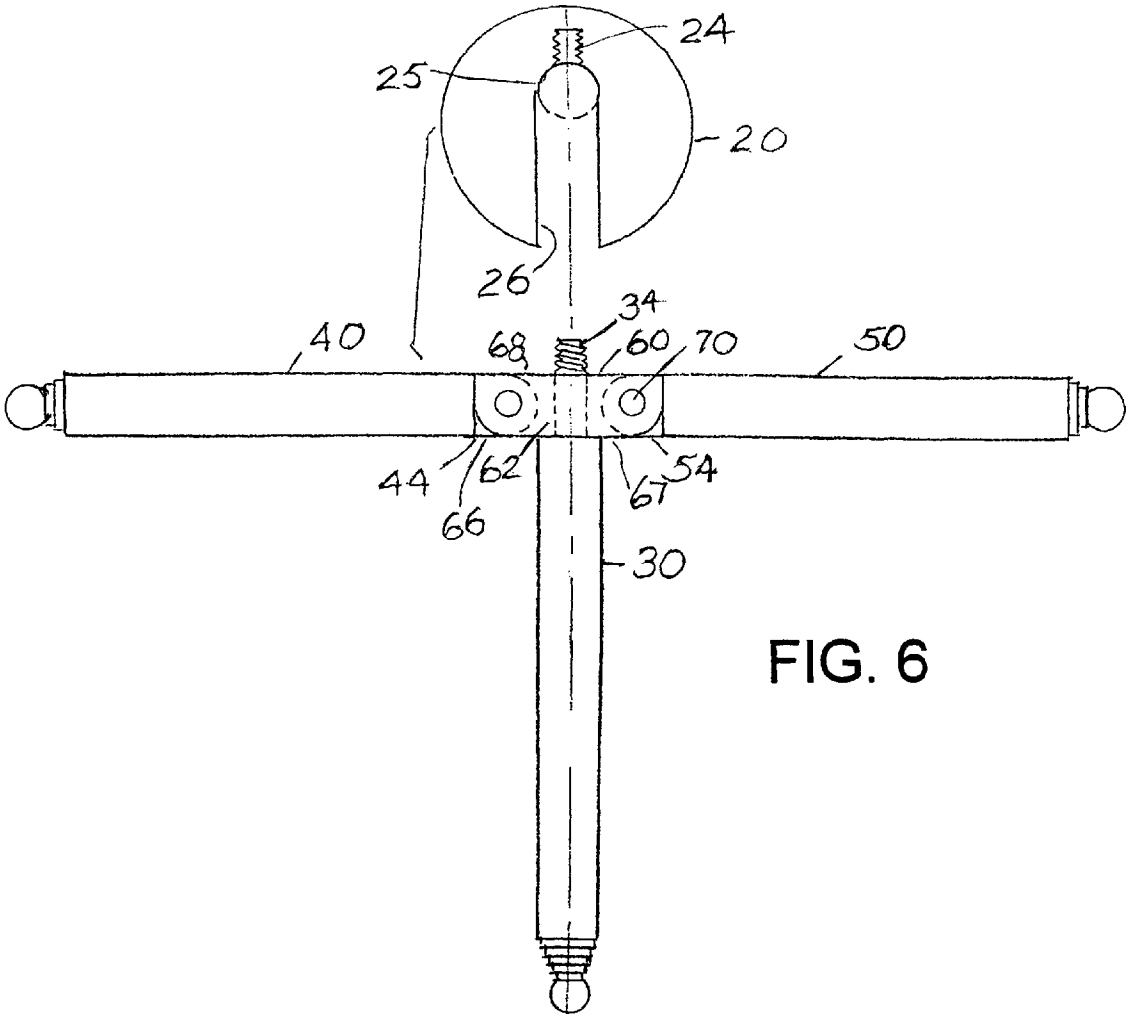
FIG. 6 is an exploded view showing the cover removed.

FIG. 6 is an exploded view of the trainer 10 showing the cover 20 removed and turned 90°. The cover 20 has been rotated 90° to show the arm-receiving slot 26 and the rounded inner top 25 of the slot to hold the hinge rod and arms. The central threaded end 34 and extension 32 of arm 30 extends through an opening in the hinge rod 60. Slots in ends of hinge rod 60 receive flat extensions 46 and 56 of arms 40 and 50. Washers between the flat ends 46, 56 and the slots 67 provide friction to hold the side arms 40, 50 in extended or folded position. Machine screws 70 fit through upper counter-sunk openings 69 in rod 60, openings 47, 57 in the flat ends 46, 56 and are secured in threaded holes in the under sides of ends of hinge rod 60. The machine screws 70 provide the pivot pins around which arms 40, 50 are swung outward or folded inward.

Figure 7:
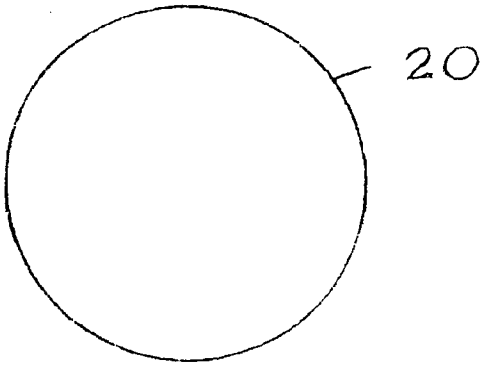
FIG. 7 is a top view of the central locator cover.

FIG. 7 is a top view of the central locator cover 20.

Figure 8:
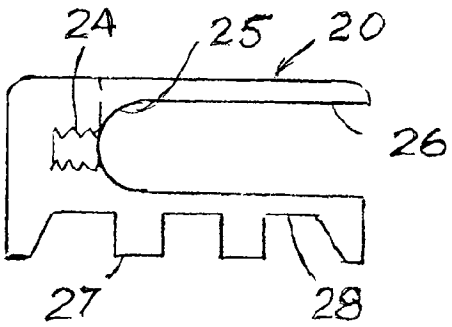
FIG. 8 is a side view of the central locator cover, showing the stabilizing ridges on the base.

FIG. 8 is a side view of the central locator cover 20, showing the slot 26 for swinging out the arms 40, 50. The hinge rod 60 is also shown and the extension 32 through the rod and threaded connection 34-24 to the cover 20. The stabilizing cleats 27 on the base 28 of the cover hold the central cover in position on the ground.

Figure 9:
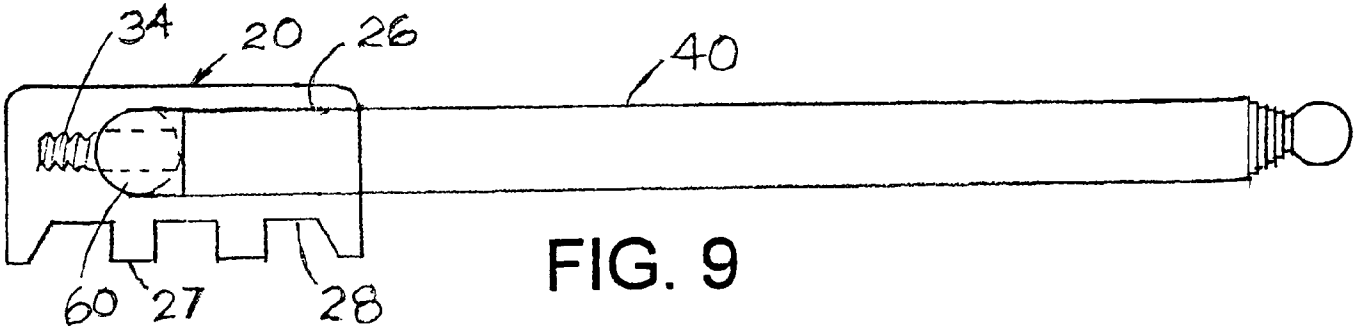
FIG. 9 is a side elevation of the central locator cover connected to the ball distance locator arm, which is shown telescoped prior to extending.

FIG. 9 is a side elevation of the central locator cover connected to the ball distance locator arm, which is shown telescoped prior to extending.

The threads 34 on extension 32 on the central arm 30 are inserted through an opening in the hinge rod 60. The slot 26 in the cover may fit the outer surfaces of tubes 38, 48 and 58 to hold the tubes in the intended positions. The slot 26 may have narrow portions between the operational and folded positions of the arms to make the arms snap into intended positions, where they are held by the cover and narrow portions. The telescoping arms may have close tolerances or felt or other inserts to hold the extensions 36 in the intended extended positions. The extensions may be twistable between sliding positions and angularly related stopped positions to precisely establish required distance between feet and required distance from the foot line to the ball. The side arms 40, 50 may be adjusted at different lengths to produce a required position of a ball with respect to the feet.

Hub 20 has an arm-receiving slot 26 with a rounded inner top 25 against which central hinge rod 60 bears and side arms 40 and 50 bear when swung out to linear positions perpendicular to central arm 30. Stabilizing cleats 27 are shown at the bottom of hub 20 to anchor the hub in the ground between feet of a user. A threaded receiver 24 in the hub receives threaded end 34 of extension 32 on the central rod 30.

Figure 10:
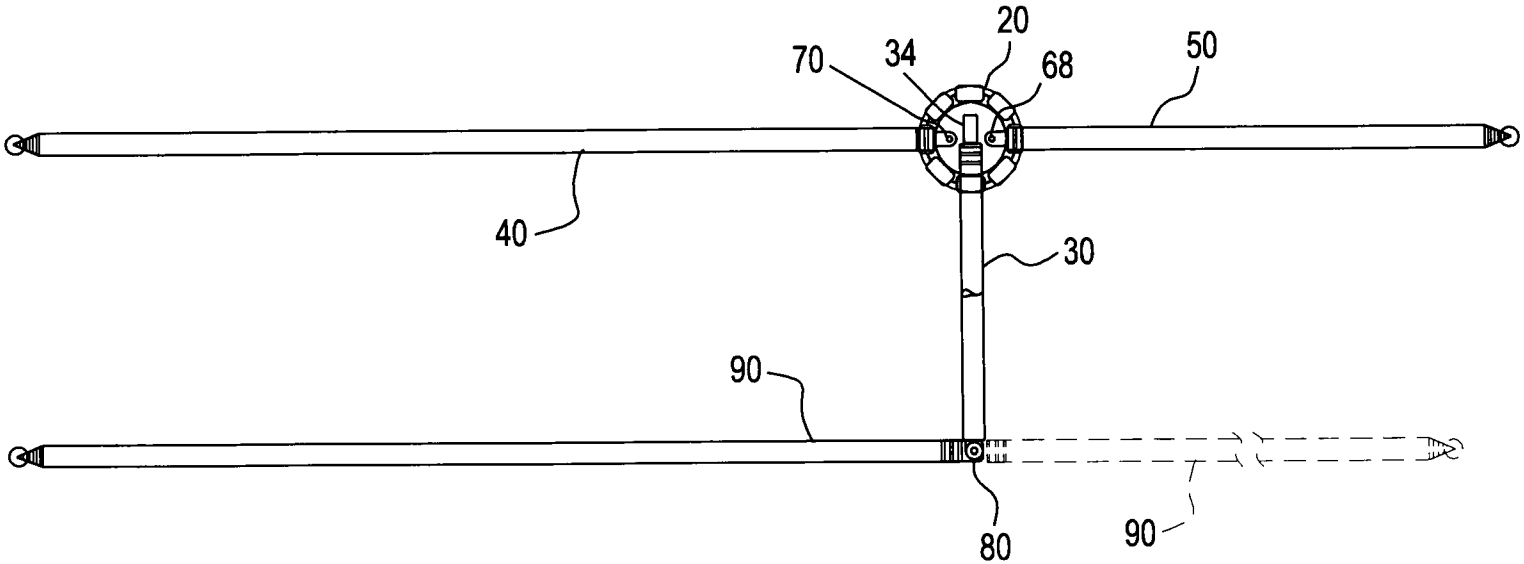
FIG. 10 is a top view of the new golf trainer.

FIG. 10 is a top view of the new golf trainer. The new golf trainer 100 has two hinged side arms 40 and 50 and a central arm 30 with a screw thread 34 on one end to extend through a hinge rod and into a threaded receiver in cover 20. Hinge pins 68 and 70 allow side arms 40 and 50 to be stored parallel to central arm 30. Central arm 30 has an extension 90 mounted on a pivot 80. The extensions may be oriented at any angle between positions parallel to arms 40 and 50, as shown in FIG. 10.

Figure 11:
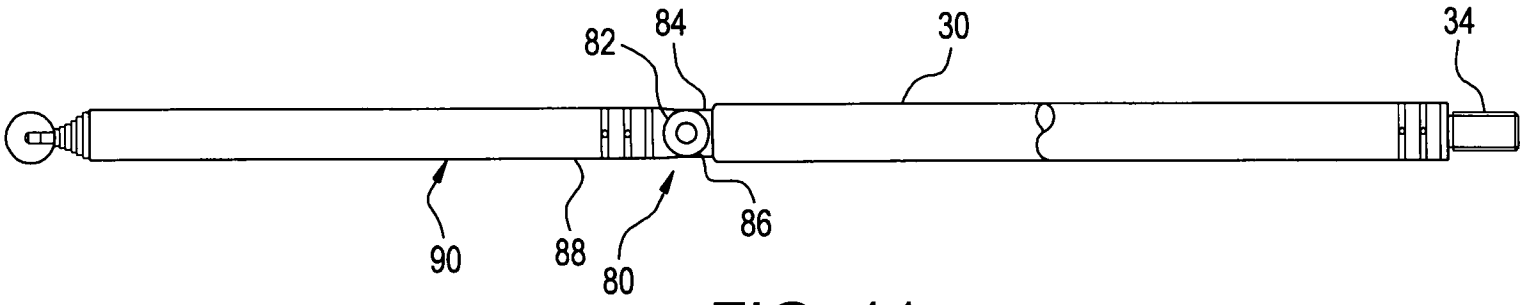
FIG. 11 is an opened view of the pivotable central arm extension of the new golf trainer.

FIG. 11 is an opened view of the pivotable central arm extension of the new golf trainer. The extension 90 is aligned with the central arm 30 ready to be telescoped inward into arm 30.

Figure 12:
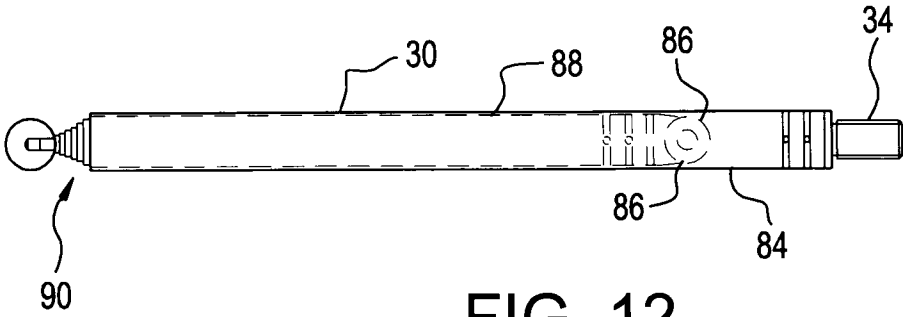
FIG. 12 is a telescoped closed view of the central arm extension of the new golf trainer.

FIG. 12 is a telescoped closed view of the central arm extension of the new golf trainer. Extension 90 is telescoped into arm 30. Pivot 80 is shown slid into arm 30. Short first inner sliding tube 84 is shown with pivot 80 inside arm 30. Tube 84 is shortened so that the entire telescoped extension fits within arm 30.

Figure 13:
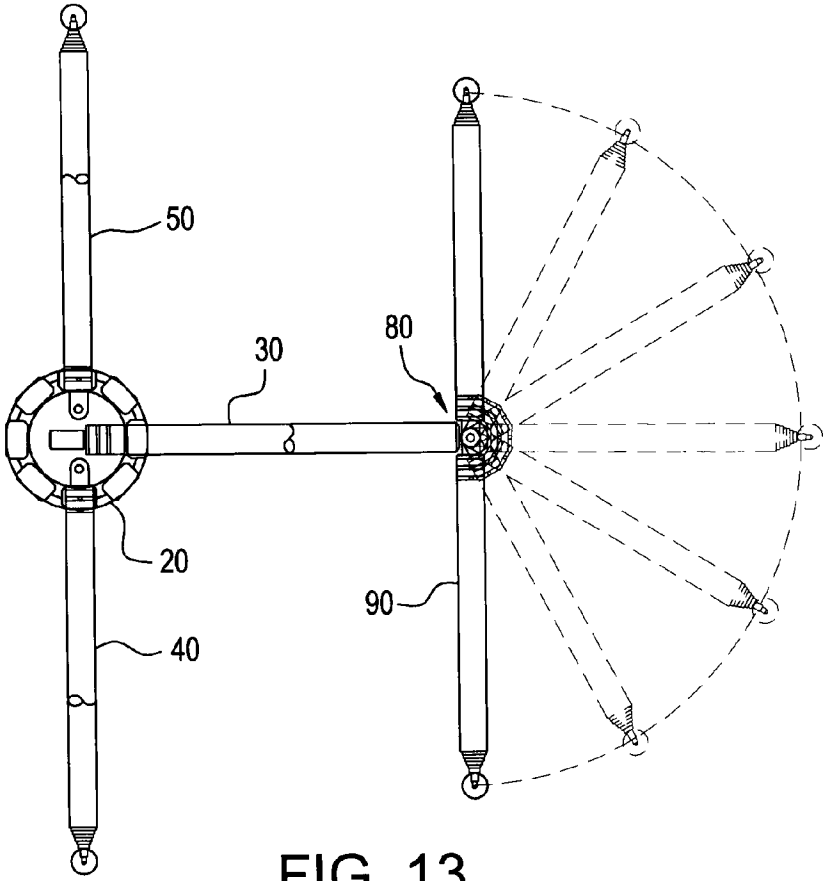
FIG. 13 is a top view of the new golf trainer showing the angles around a vertical axis through which the central arm extension of the new golf trainer may be moved.

FIG. 13 is a top view of the new golf trainer showing the angles around a vertical axis through which the central arm extension of the new golf trainer may be moved. The extension 90 is shown to be rotatable in any angle which forms a hemisphere centered on the pivot 80. The hemisphere is limited to no closer than parallel to the extended arms 40 and 50 by virtue of the hinge 80 and twistable through any angle about a longitudinal axis of the central arm 30. A spherical limit may be extended by extending the clevis 82 on the first inner tube 84. The clevis 82 is shown on the outer end of the first inner short tube 84 and the projection 86 on the inner end of the second inner tube 88 in extension 90. The clevis and projection on the ends of the tubes may be interchanged.

Figure 14:
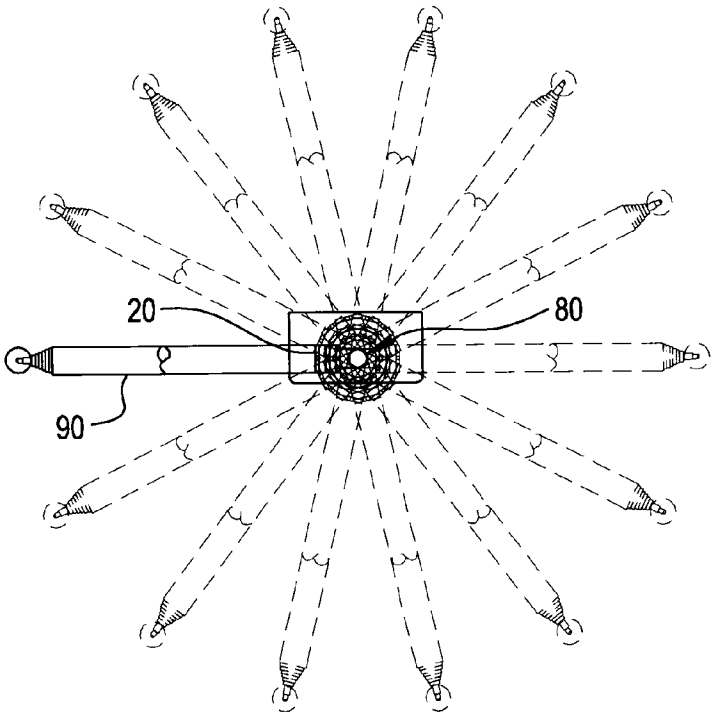
FIG. 14 is a partial end view of the new golf trainer showing 360° freedom of alignment of a central arm extension about a horizontal axis.

FIG. 14 is a partial end view of the new golf trainer showing 360° freedom of alignment of a central arm extension about a horizontal axis.

Figure 15:
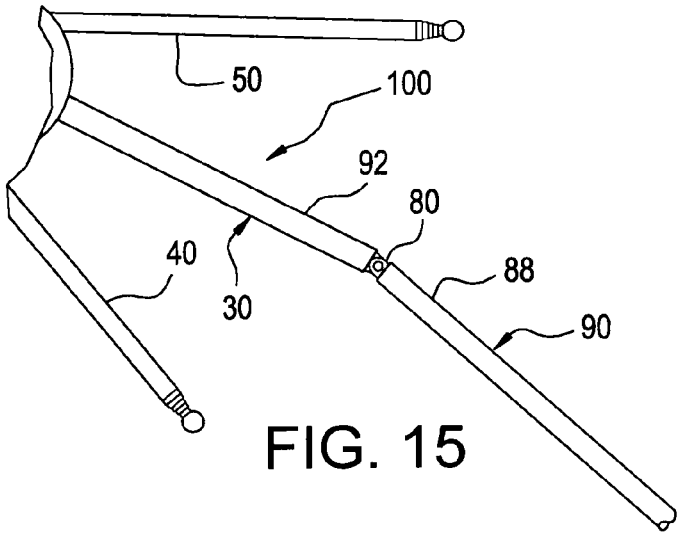
FIG. 15 is a top view of the trainer with hinged arms partially swung outward and with the central arm extension partially extended and turned.

FIG. 15 shows hinged side arms 40 and 50 partially hinged outward and an angular extension 90 extending from the central arm 30. The angular extension 90 from the central arm 30. The angular extension 90 may be hinged from a pivot 80 on an outer end of the central arm outer casing 92 or may be hinged on a pivot 80 between an outer end of a first inner tube 84 and a first inner end of a second inner tube 88, as shown in FIGS. 4 and 5.

Figure 16:
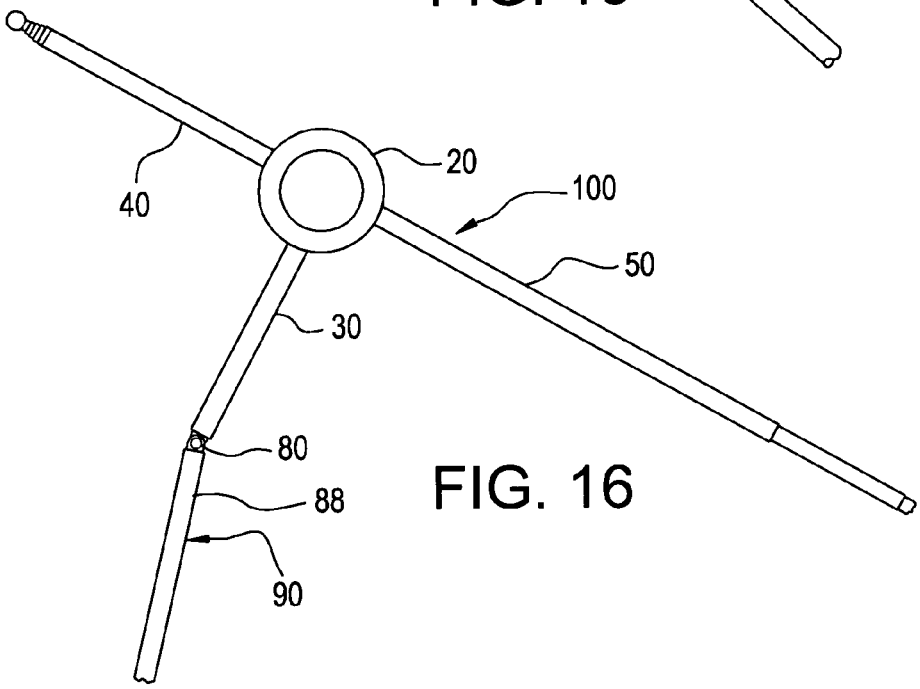
FIG. 16 is a top view of the trainer showing hinged arms swung outward with one arm extended and showing the central extension pivoted at an angle.

FIG. 16 shows the central cover 20 and the hinged side arms 40 and 50 extended perpendicularly to central arm 30. Arm 50 has been extended and angular extension 90 has been pivoted on pivot 80.

Figure 17:
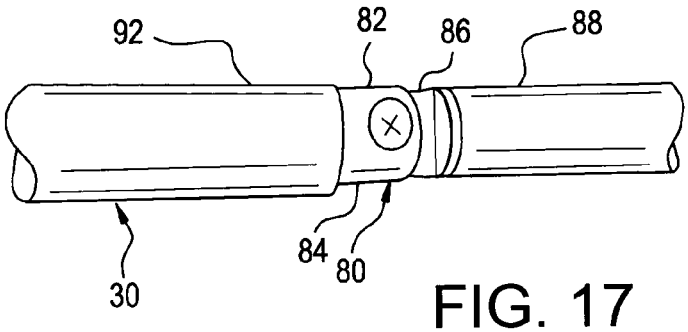
FIG. 17 is an enlarged detail showing the pivots on the central arm extensions pulled outward from the outer telescoping tube.
Figure 18:
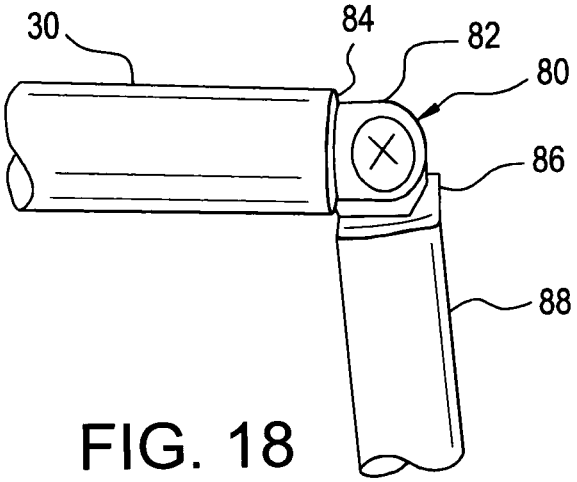
FIG. 18 is an enlarged detail of the central arm extension turned around the connected pivots.
Figure 19:
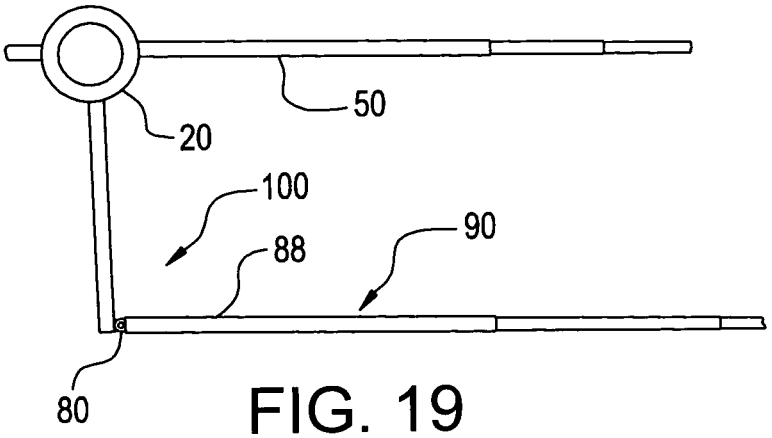
FIG. 19 is a partial view of the trainer showing extensions of one hinged arm and the central arm.
Figure 20:
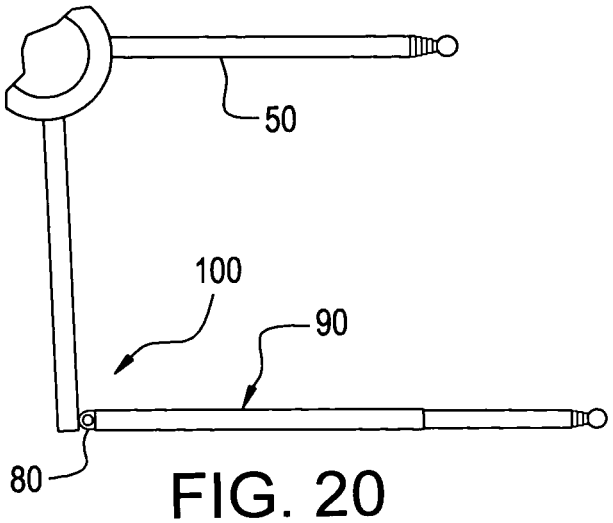
FIG. 20 is a partial view of the trainer showing the central arm extension and one hinged arm telescoped inwardly.

FIGS. 17 and 18 show the pivot 80 which may be formed as a clevis 82 on the outer end of the first inner tube 84 in central arm 30 or on the outer end of outer tube 92 of central arm 30. A projection 86 is formed on the inner end of the second inner tube 88. Projection 86 fits within the clevis 82. A Phillips round head set screw fits through a counter sunk hole in one side of clevis 82, through a hole in projection 86 and into a threaded hole in the other side of the clevis, completing the pivot 80. The pivot 80 is formed between the outer end of a first inner tube and an inner end of a second inner tube. The first inner tube is shortened, so that the remainder of the inner tubes that form the extension 90 may be telescoped into the central arm for storage. FIG. 13 shows the extension 90 turned on the pivot 80 at an angle to the central arm 30.

FIG. 14 shows the central arm extension in its extended form and positions at an angle slightly greater than 90° to central arm 30.

FIG. 15 shows a shortened telescoped hinged arm 50 and a shortened partially telescoped central arm extension 90.

While the invention has been described with reference to specific embodiments, modifications and variations of the invention may be constructed without departing from the scope of the invention, which is defined in the following claims.

I claim:

1. Apparatus comprising a golf stance trainer having three arms, a central arm and two side arms, each arm having first and second ends, one side arm being positioned on either side of the central arm, a hinge device connected to the arms, the hinge device has a central receiver for receiving a first end of the central arm, the hinge device having first and second ends, a first hinge connection at the first end and a second hinge connection at the second end of the hinge device, the side arms and the central arm being aligned for storing and carrying, and the first ends of the side arms being hinged to the hinge device for swinging out so that the second ends of the side arms are spaced from each other for use, the central arm having a pivoted extension for positioning angularly to the central arm for training ball positioning or aiming, and the pivoted extension further comprises telescoping tubes, and further comprising a pivotable connection between an inner telescoping tube of the central arm and an outer telescoping tube of the pivoted extension.

2. The apparatus of claim 1, wherein the hinge device comprises a hinge rod and wherein the hinge connections comprise slots in the first and second ends of the hinge rod.

3. The apparatus of claim 2, further comprising holes through the first and second slotted ends of the hinge rod perpendicular to the slots, complementary holes in the first ends of the side arms and first and second pins extending through the holes in the hinge rod and complementary holes in the first ends of the side arms.

4. The apparatus of claim 3, wherein the pins are screws.

5. The apparatus of claim 3, further comprising a cover having a cover slot and having a connector extending inward from a center of the cover slot for holding the first end of the central arm, the cover slot receiving the hinge rod with the first ends of the side arms connected to the hinge rod with the pins, the first end of the central arm having a complementary connector for extending through the receiver in the hinge rod and joining with the connector in the cover, holding the hinge rod and first ends of the side arms assembled in the cover.

6. The apparatus of claim 5, wherein the cover and cover slot extend outward beyond the ends of the hinge rod for limiting outward swinging travel of the side arms to positions in which the side arms are perpendicular to the central arm.

7. The apparatus of claim 6, wherein the cover has upper and lower surfaces parallel to sides of the cover slot, and wherein the lower surface has cleats for securing the cover against motion.

8. The apparatus of claim 1, wherein the arms are telescoping and extensible and are telescoped inward for carrying and storing and are extended outward for use.

9. The apparatus of claim 1, wherein a first inner tube is relatively short in an axial direction and a second inner tube is relatively long in an axial direction, further comprising further inner tubes connected sequentially with the second inner tube for telescopically storing the further inner tubes within the second inner tube and storing the first and second inner tubes telescopically within the central arm.

10. The apparatus of claim 1, wherein the first pivot part is a clevis and the second pivot part is a projection, further comprising a pin for rotatably connecting the clevis and the projection.

11. Apparatus comprising a golf swing stance trainer for training user foot positions with respect to a golf ball position, the golf swing stance trainer further comprising a hub, a central arm having first and second ends, the first end of the central arm connected to the hub, and further comprising hinges connected to the hub, the stance trainer further comprising side arms having first and second ends, the first ends of the side arms connected to the hinges for enabling swinging of the side arms inward toward the central arm for storing and carrying with the arms parallel and for enabling swinging the side arms outward with the second ends of the side arms spaced from each other for positioning of user's feet with the side arms, and positioning of a golf ball with the central arm in preparation for swinging a golf club, the central arm having a pivoted extension for positioning angularly to the central arm for training ball positioning or aiming.

12. The apparatus of claim 11, wherein the arms are telescoping and extensible.

13. The apparatus of claim 11, wherein the central arm is a tube, and further comprising a first inner tube within the central arm tube and a second inner tube within the central arm tube, and wherein an outer end of the first inner tube has a first pivot part and the inner end of the second inner tube has a second pivot part connected to the first pivot part.

14. The apparatus of claim 13, wherein the first inner tube is relatively short in an axial direction and the second inner tube is relatively long in an axial direction, further comprising further inner tubes connected sequentially with the second inner tube for telescopically storing the further inner tubes within the second inner tube and storing the first and second inner tubes telescopically within the central arm.

15. The apparatus of claim 13, wherein the first pivot part is a clevis and the second pivot part is a projection, further comprising a pin for rotatably connecting the clevis and the projection.

16. A method comprising using a golf stance trainer by extending a central arm from a hub, positioning a golf ball, with respect to the central arm, swinging side arms outward on hinges in the hub and extending the side arms, pulling an extension from the central arm and turning the extension about a pivot at an end of the central arm, positioning a user's feet using the side arms as a guide, and positioning a golf ball and directing a golf ball and swing using the pivoted extension from the central arm as a guide, further comprising telescoping the central arm inward, telescoping the side arms inward and swinging the side arms inward parallel to the central arm for carrying or storing the golf stance trainer.

17. The method of claim 16, wherein the swinging of the side arms outward further comprises positioning the side arms perpendicular to the central arm.

18. The method of claim 16, further comprising stepping on the hub and pressing cleats on a bottom of the hub into the ground.

19. A method comprising providing a golf stance trainer having three arms, a central arm and two side arms, each arm having first and second ends, one side arm being positioned on either side of the central arm, providing a hinge device connected to the arms, providing a central receiver on the hinge device for receiving a first end of the central arm, providing first and second hinge ends on the hinge device, providing a first hinge connection at the first hinge end, providing a second hinge connection at the second hinge end of the hinge device, aligning the side arms and the central arm for storing and carrying the golf stance trainer, in use swinging out the side arms from the hinge device and spacing the second ends of the side arms from each other, providing a pivoted extension on the central arm, positioning the pivoted extension angularly to the central arm for training ball positioning or aiming, providing telescoping tubes in the pivoted extension and in the central arm, and providing a pivotable connection between an inner telescoping tube of the central arm and an outer telescoping tube of the pivoted extension.

* * * * *